US006477969B2

(12) United States Patent
Schell-Tomczak et al.

(10) Patent No.: US 6,477,969 B2
(45) Date of Patent: Nov. 12, 2002

(54) BOAT WITH CENTER PONTOON AND SEPARATE MOTOR MOUNT

(75) Inventors: Linda Schell-Tomczak, Fenton; Anthony J. Seconsky; Kevin L. Huff, both of Owosso, all of MI (US)

(73) Assignee: Maurell Products, Inc., Owosso, MI (US)

( * ) Notice: Subject to any disclaimer, the term of this patent is extended or adjusted under 35 U.S.C. 154(b) by 0 days.

(21) Appl. No.: 09/849,690

(22) Filed: May 3, 2001

(65) Prior Publication Data

US 2002/0046688 A1 Apr. 25, 2002

Related U.S. Application Data

(60) Provisional application No. 60/243,113, filed on Oct. 25, 2000.

(51) Int. Cl.[7] ..... B63B 1/00
(52) U.S. Cl. ..... 114/61.1; 440/49; 440/53
(58) Field of Search ..... 114/61.1; 440/53, 440/49

(56) References Cited

U.S. PATENT DOCUMENTS

| | | | | |
|---|---|---|---|---|
| 3,289,226 A | * | 12/1966 | Thompson | 114/361 |
| 3,942,457 A | * | 3/1976 | Keyes et al. | 111/200 |
| 5,191,848 A | * | 3/1993 | Hatfield | 114/61.2 |
| 5,259,331 A | * | 11/1993 | Hagan | 114/61.1 |
| 5,911,187 A | * | 6/1999 | Sohm | 114/283 |

* cited by examiner

*Primary Examiner*—Stephen Avila
(74) *Attorney, Agent, or Firm*—Welsh & Katz, Ltd.

(57) ABSTRACT

A center pontoon for a pontoon boat provides improved performance and an adjustable engine mount. The adjustable engine mount makes it possible to adjust the relative position of an outboard engine relative to the waterline of the boat. The center pontoon includes a relieved top surface for allowing a vertical adjustment movement of the engine mount. The mount has an elongated, mount body which is adjustably attached to the bottom of the hull of the boat by a pair of spaced apart, elongated mounting rails. The mount body has a vertical profile that is compatibly shaped with the relieved top surface to provide sufficient vertical adjustable movement. The engine mount is located between a pontoon boat deck and the center pontoon.

36 Claims, 6 Drawing Sheets

BOAT WITH CENTER PONTOON AND SEPARATE MOTOR MOUNT

This application claims the benefit of U.S. Provisional Application No. 60/243,113 filed Oct. 25, 2000.

FIELD OF THE INVENTION

The invention pertains to mounts for outboard engines. More particularly, the invention pertains to adjustable mounts intended for use with pontoon boats.

BACKGROUND OF THE INVENTION

Pontoon boats include a pair of elongated pontoons which support a platform spanning between the pontoons. An outboard engine or outboard motor (terms used interchangeably) is supported from the platform at a position intermediate the pontoons at a rear of the boat.

An engine mount is connected to an underside of the platform. The engine mount comprises an elongated hollow body or trough which extends longitudinally and rearwardly of the rear end (stem end) of the platform. The body is exposed to the water beneath the boat. The engine mount is substantially closed except for a top opening at a rear of the boat. A fuel tank is held within the body, accessed through the top opening. The outboard motor is bolted to the rear wall of the body.

The prior known mount is non-adjustably fixed to the platform. No range of vertical adjustment for the outboard engine is provided by the mount.

U.S. Ser. No. 09/641,061, filed Aug. 17, 2000, entitled "Engine Mount," and assigned to the assignee of the present application, discloses a vertically adjustable engine mount for a watercraft, arranged between side pontoons.

The present inventors have recognized that it would be desirable to provide a center pontoon for a watercraft, to improve performance and turning of the watercraft, wherein the center pontoon is compatible with a vertically adjustable engine mount of the watercraft.

SUMMARY OF THE INVENTION

A watercraft, such as a pontoon boat, includes a platform supported on a pair of outside pontoons and a center pontoon. The center pontoon includes a substantially cylindrical body having a relieved top surface at a rear end of the cylindrical body.

The watercraft includes an adjustable engine mount for mounting an outboard motor or engine at adjustable heights with respect to the platform, and in effect, to the waterline. The engine mount includes a mount body pivotally connected to the platform at a forward end, and vertically adjustable with respect to the platform at a rearward end.

The mount body includes a rear wall which carries the outboard motor. The mount body overlies the center pontoon in substantial part over the relieved top surface of the cylindrical body.

The relieved top surface of the cylindrical body of the center pontoon allows clearance for adjustable vertical movement of the mount body. The relieved top surface can be formed by a flat wall portion angled downwardly toward a rear of the boat. Alternatively, the relieved top surface can be formed by a concave profile trough or indent, preferably sloped downwardly toward a rear of the boat.

The use of a center pontoon increases the flotation, turning and performance of the boat. Providing the flexibility of vertical adjustment of the outboard motor with the center pontoon further increases the overall turning and performance of the boat.

The present invention may create a "hard water pocket" in the vicinity of the propeller which also improves performance of the watercraft.

The adjustable engine mount includes a tapered, elongated body which is couplable to, and vertically adjustable relative to, the hull of the boat. The body has a first, smaller end oriented toward the bow of the watercraft and a second, wider end positioned adjacent to the stern of the craft.

An engine-mounting wall or mounting plate is attached to the second end of the body. An outboard motor or outboard engine can be attached to the mounting plate.

By vertically adjusting the body with respect to the hull, the elevation of the outboard motor with respect to the watercraft or with respect to the waterline, can be adjusted. The adjustment can be utilized to optimize performance of an outboard motor. The adjustment provides flexibility and facilitates the use of different model outboard motors on the watercraft.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
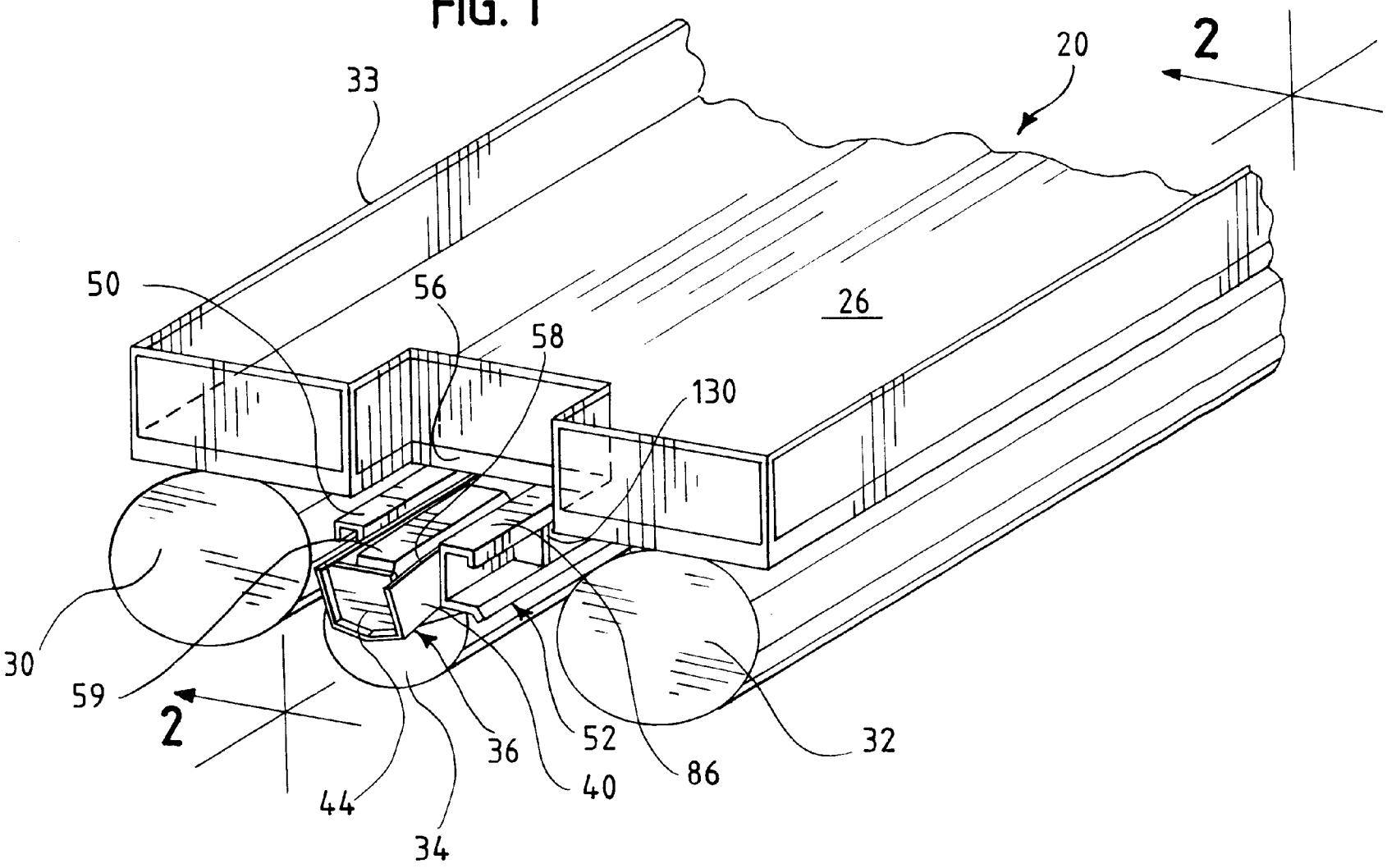
FIG. 1 is a perspective view of a watercraft utilizing the center pontoon and engine mount of the present invention, wherein an outboard motor is not shown for clarity of view of the engine mount.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates a watercraft 20. The watercraft 20 includes a platform 26 supported on parallel, outside, buoyancy-providing housings, such as outside pontoons 30, 32, and a center buoyancy-providing housing, such as a center pontoon 34. The platform 26 is adapted to carry payload, such as passengers or cargo. For simplicity, the platform is shown as a plain floor surrounded by a railing 33. The platform could be adapted to provide seating for people, or storage for cargo, or structure for a houseboat, as only a few examples.

Mounted to the platform 26, above the center pontoon 34, is an elongated engine mount 36. The engine mount 36 is described more completely in U.S. Ser. No. 09/641,061 filed Aug. 17, 2000, herein incorporated by reference.

The engine mount 36 includes a trough-like hollow mount body 40, closed at a rear end (stern end) by an engine-mounting wall or plate 44. An outboard motor (shown in FIG. 2) is coupled to the wall 44 as described below. The mount body 40 is connected intermittently along its length to support rails 50, 52. The support rails 50, 52 are connected intermittently along lengths thereof to an underside of the platform 26.

The engine mount 36 extends rearwardly of a back edge 56 of the platform 26, defining a top opening 58. A fuel tank 59 can be carried in with the mount body 40, exposed through the opening 58.

Figure 2:
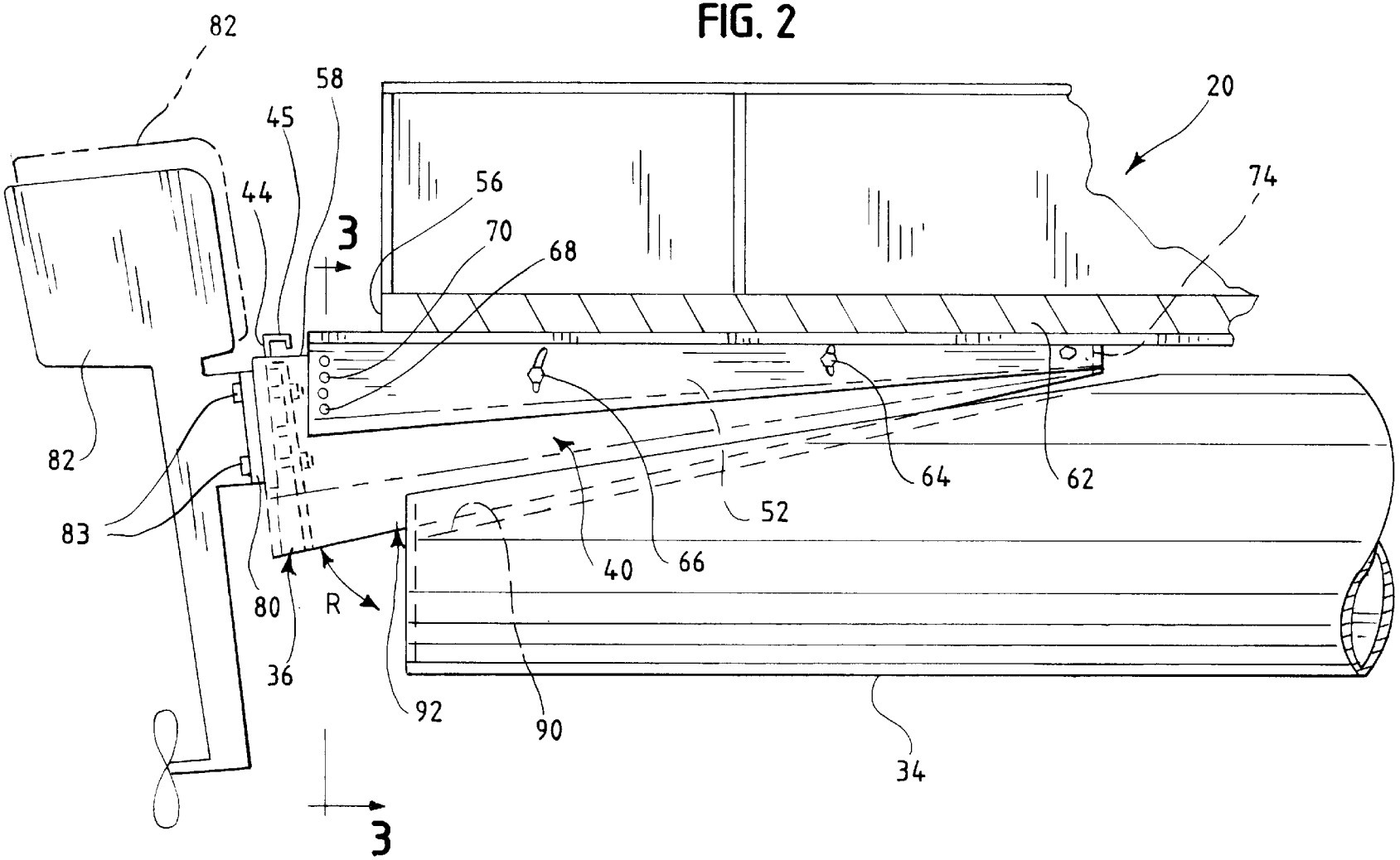
FIG. 2 is a sectional view taken generally along line 2—2 of FIG. 1, with an outboard motor installed.

FIG. 2 illustrates the engine mount 36 beneath the watercraft 20. The rail 52 is connected to the body 40 by five bolted connections 62, 64, 66, 68, 70. An end plate 74 substantially closes a front end (bow end) of the mount body 40.

A motor plate 80 supports an outboard motor 82. The motor plate 80 is bolted to the engine-mounting wall 44 using bolts 83. The mounting wall 44 includes a top channel portion 45 which reinforces the top free edge of the wall 44 and also provides a guiding retainer for a fuel line, control cables or other like devices.

The connection 62, 64, 66, 68, 70 can be loosened and the mount body 40 can be pivoted about the connection 62, in the direction R, to adjust the elevation of the motor 82. After adjustment, all the connections 62, 64, 66, 68, 70 can be tightened.

The center pontoon 34 includes a cylindrical body 89 with a relieved top surface 90 (shown in FIG. 3) which receives a bottom portion 92 of the mount body 40 therein to partially overlap in vertical profile. This allows an increased vertical adjustment range of the mount body between the platform and the center pontoon.

Figure 3:
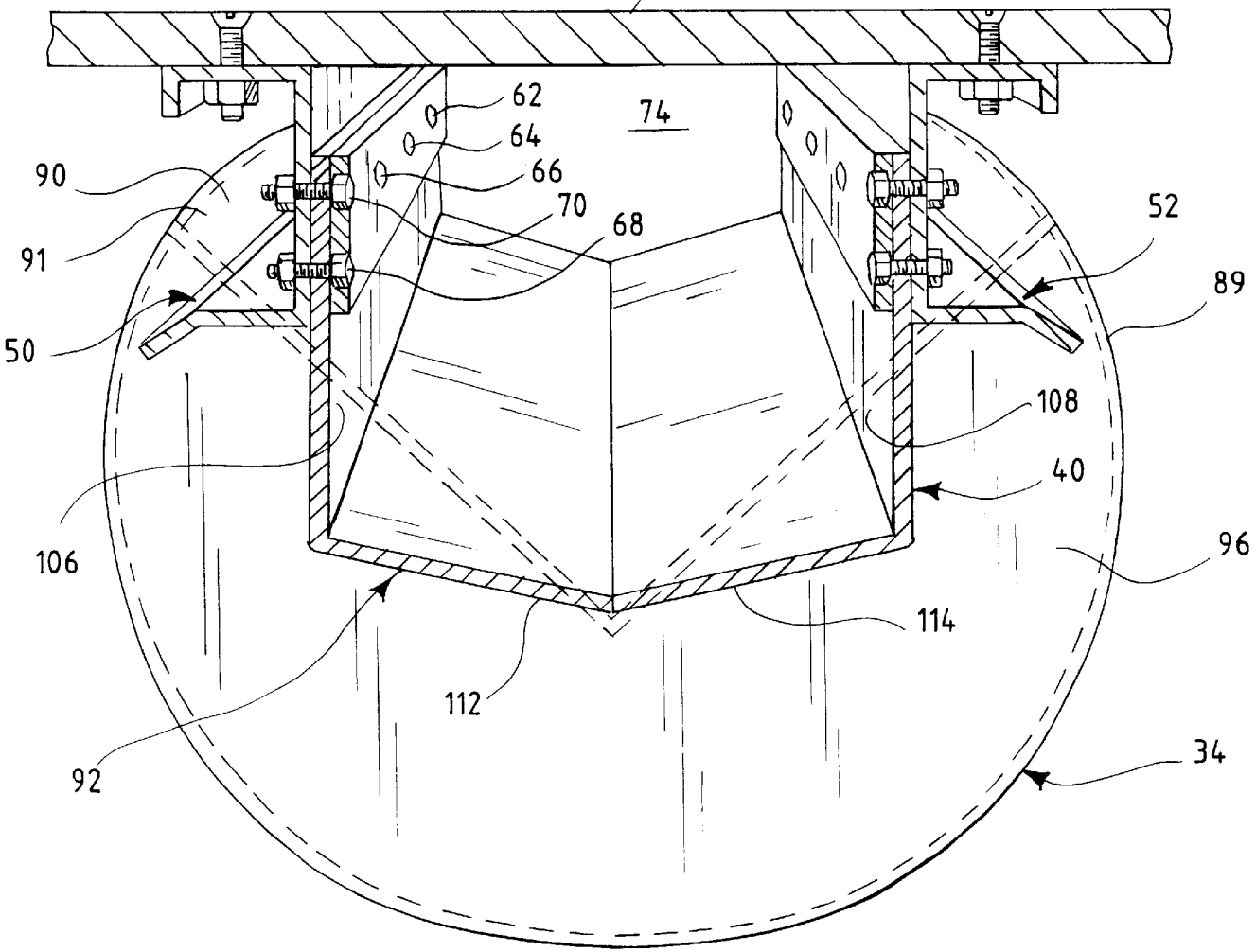
FIG. 3 is an enlarged sectional view taken generally along lines 3—3 of FIG. 2.

FIG. 3 illustrates the body 40 has side walls 106, 108 and bottom walls 112, 114. The side wall 106, 108 are bolted to the side rails 50, 52 respectively, by the connections 62, 64, 66, 68, 70. The side rails are bolted to the deck 26. The lower portion 92 of the mount body 40 includes the bottom walls 112, 114.

The relieved top surface 90 of the pontoon cylindrical body 89 is shaped by a V-shaped wall 91 inclined downwardly toward a rear of the watercraft. The center pontoon 34 also includes a flat end wall 96. The cylindrical body 89, the V-shaped wall 91 and the end wall 96 are integrally welded together to form a sealed pontoon.

Figure 4:
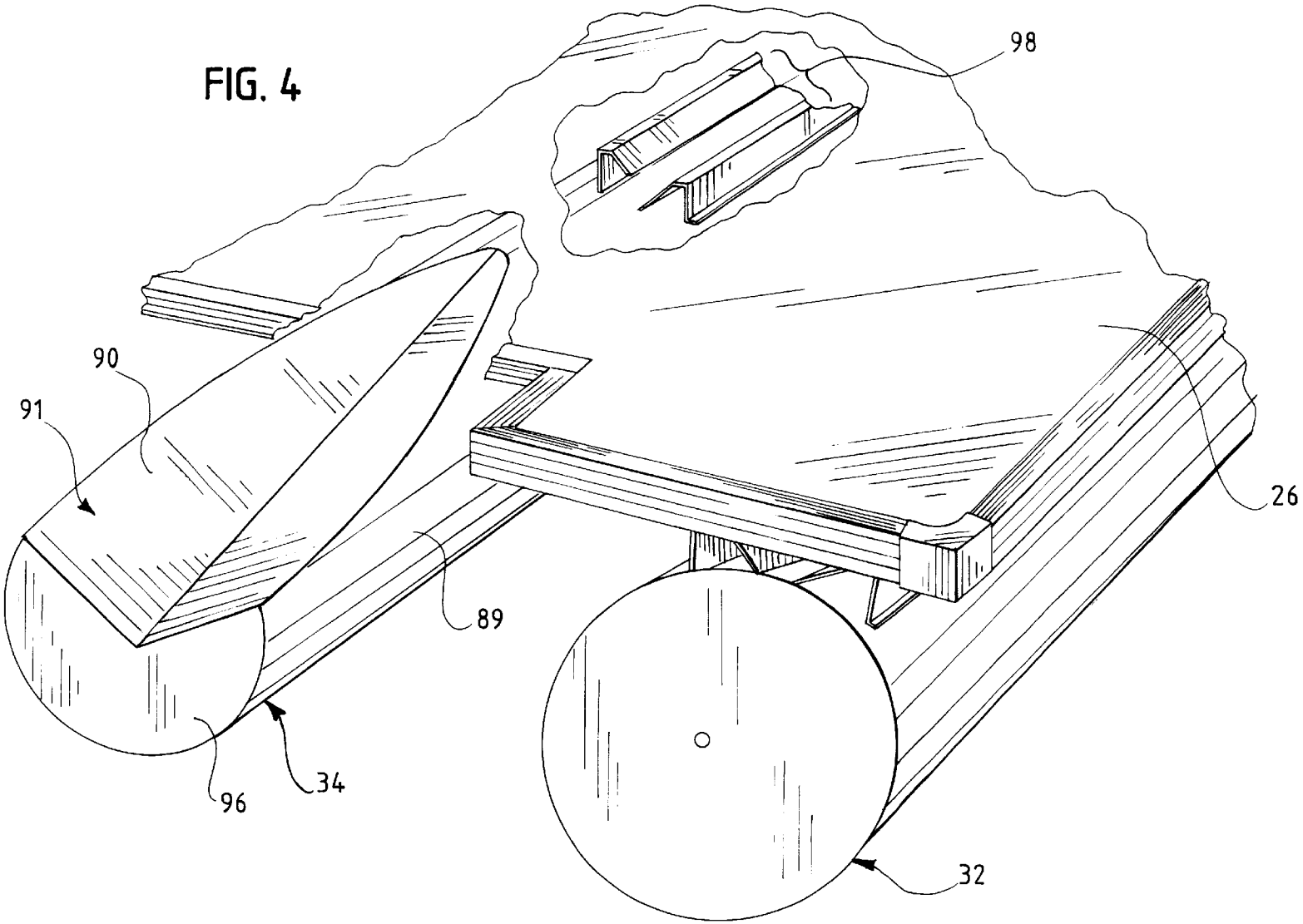
FIG. 4 is a fragmentary perspective view of an end of the watercraft with the engine mount removed for purpose of description.

FIG. 4 illustrates the V-shaped wall 91 forming the relieved surface 90. The center pontoon 34, and the outer pontoons 30, 32, are connected to the deck 26 using a plurality of M-shaped brackets 98 which are welded to the pontoon 34 and fastened or welded to the deck 26.

Figure 5:
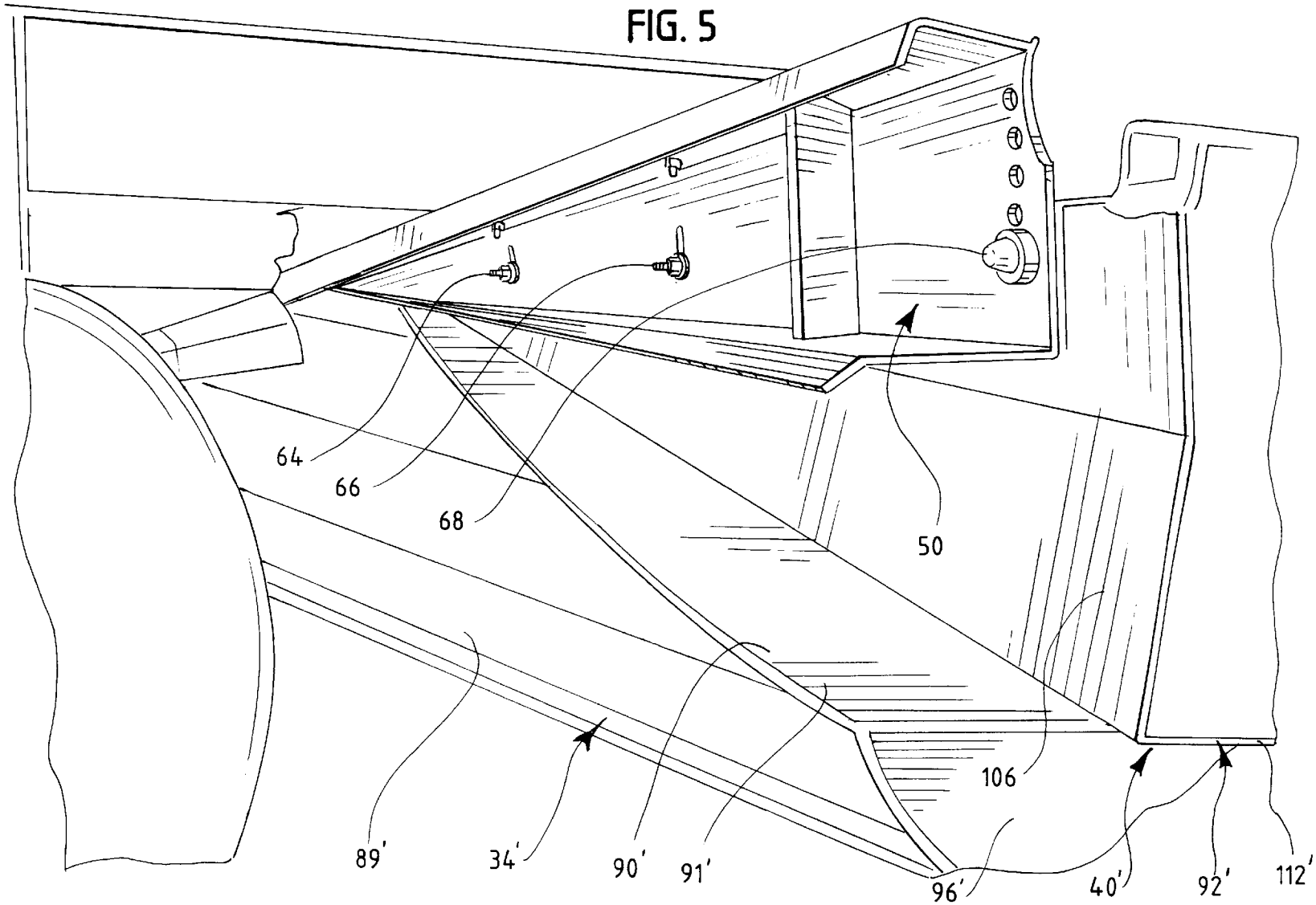
FIG. 5 is a fragmentary perspective view of a rear end of an alternate embodiment wartercraft.

FIG. 5 illustrates an alternate embodiment mount body 40' having a flat bottom area 92' formed by a flat bottom wall 112', replacing the obliquely arranged bottom walls 112, 114 of the first embodiment.

An alternate center pontoon 34' includes a flat inclined top surface 90' formed by a flat inclined wall 91'. The inclined wall 91', an alternate cylindrical body 89' and an alternate end wall 96' are integrally welded together to form a sealed pontoon. The inclined wall 91' allows an increased vertical range of motion for a rear end of the mount body 40'.

Figure 6:
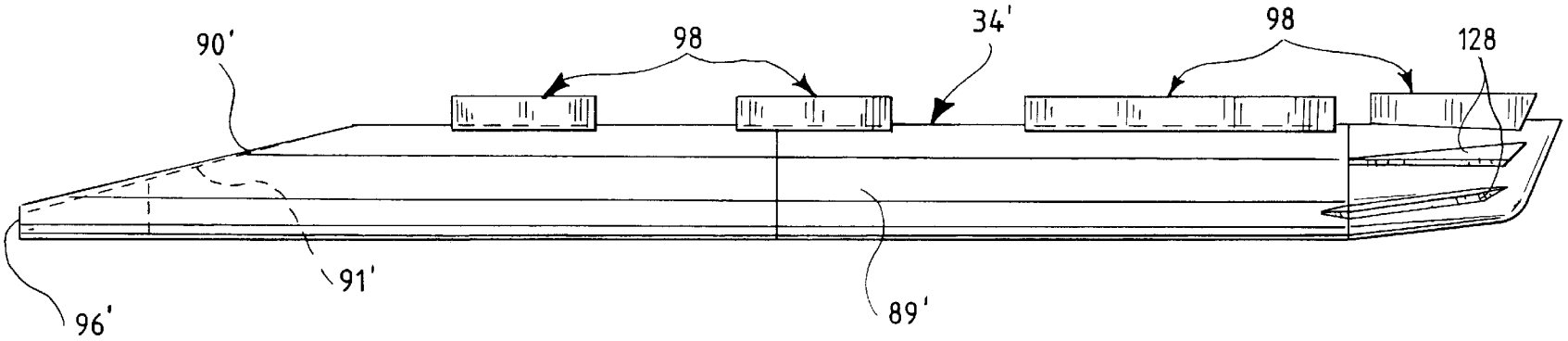
FIG. 6 is an elevational view of the center pontoon taken from FIG. 5.
Figure 7:
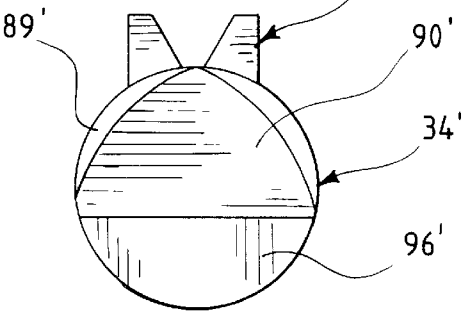
FIG. 7 is a right side view of the center pontoon of FIG. 6.

FIGS. 6 and 7 illustrate the pontoon 34' of FIG. 5 in more detail. The center pontoon is attached to the deck 26 by a plurality of M-shaped brackets 98 spaced along a length of the pontoon 34'. One or more wings or splash guards 128 are arranged on a front end of the pontoon to decrease splashing and increase performance.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A watercraft comprising:

an above-water portion for a user;

an elongated, sealed, buoyancy-providing housing coupled to a water side of the above-water portion wherein the housing is centrally located with respect to one dimension of the above-water portion;

an engine mount movably coupled to the above-water portion and the housing; and wherein the housing is substantially cylindrical with at least one surface adjacent to the engine mount and oriented in a direction to provide an adjustment region into which at least a portion of the engine mount can be moved throughout a predetermined range.

2. A watercraft as in claim 1, wherein the above-water portion is elongated and substantially rigid with a central axis and wherein the housing extends substantially along that axis.

3. A watercraft as in claim 2, wherein the engine mount is coupled to an end of the above-water portion on the central axis.

4. A watercraft as in claim 3, wherein the engine mount is sandwiched between the above-water portion and the housing.

5. A watercraft as in claim 4, wherein when the above-water portion is oriented substantially horizontal and the engine mount is movable generally perpendicularly.

6. A watercraft as in claim 1, wherein the housing has at least two surfaces adjacent to the engine mount so as to provide the adjustment region.

7. A watercraft as in claim 6, wherein the two surfaces form a V-shaped region which extends away from the engine mount.

8. A watercraft as in claim 7, which includes first and second spaced apart buoyancy-providing elements with the housing located therebetween.

9. A watercraft as in claim 8, wherein the buoyancy-providing elements are cylindrical and elongated.

10. A watercraft as in claim 9, wherein the housing is elongated and cylindrical except in the vicinity of the engine mount and wherein the housing extends parallel to and between the buoyancy-providing elements.

11. A watercraft as in claim 10, wherein the above water portion has a planar deck and wherein the deck extends parallel to the housing.

12. A watercraft as in claim 10, wherein an engine is coupled to the engine mount to propel the watercraft.

13. A pontoon boat comprising:

a deck;

at least one buoyancy-providing pontoon coupled to a water side of the deck;

an engine mount movably coupled to the water side of the deck adjacent to at least an end of the pontoon and movable relative to the pontoon;

wherein an end of the pontoon exhibits an engine mount depression permitting movement of the mount, and wherein the depression includes first and second intersecting planar surfaces.

14. A pontoon boat as in claim 13 which includes second and third buoyancy-providing pontoons coupled to the water side of the deck spaced apart from the one pontoon.

15. A pontoon boat as in claim 13, wherein the engine mount extends from an end of the pontoon.

16. A pontoon boat as in claim 15, wherein the engine mount is movable in a direction generally perpendicular to the direction in which the mount extends from the end of the pontoon.

17. A pontoon boat as in claim 13, which includes an engine coupled to the mount with a water side extension for propelling the boat in a water environment.

18. A pontoon boat comprising:

a deck;

at least one buoyancy-providing pontoon coupled to a water side of the deck;

an engine mount movably coupled to the water side of the deck adjacent to at least an end of the pontoon and movable relative to the pontoon;

wherein an end of the pontoon exhibits an engine mount depression permitting movement of the mount, and wherein the engine mount, the water side extension and the engine mount depression cooperate to enhance performance of the boat.

19. A pontoon boat as in claim 18 which includes second and third buoyancy providing pontoons coupled to the water side of the deck spaced apart from the one pontoon.

20. A watercraft, comprising:

a platform for carrying a payload;

a pair of side pontoons arranged beneath the platform for supporting the platform above a water line;

an engine mount assembly arranged between the pontoons, said engine mount assembly including an elongated mount body pivotally connected at a front end thereof to said platform and connected at a rear end thereof at a selected vertical position to said platform, and an engine-mounting wall connected to said mount body at said rear end;

a center pontoon arranged beneath said platform between said side pontoons; and an outboard motor mounted to said engine-mounting wall.

21. A watercraft according to claim 20, wherein said center pontoon comprises a substantially cylindrically body with a relieved top surface, said relieved top surface positioned in part beneath said elongated mount body to allow a range of vertical, position-adjusting movement of a rear end of said mount body.

22. The watercraft according to claim 20, wherein said center pontoon comprises a flat end wall at a rear end thereof.

23. The watercraft according to claim 20, wherein said relieved surface comprises a flat wall angled downwardly toward a rear of said watercraft.

24. The watercraft according to claim 20, wherein said relieved surface comprises a concave wall.

25. The watercraft according to claim 20, wherein said concave wall is angled downwardly toward a rear of said watercraft.

26. The watercraft according to claim 20, wherein said relieved surface comprises a V-shaped indentation.

27. The watercraft according to claim 20, wherein said V-shaped indentation is angled downwardly toward a rear of said watercraft.

28. The watercraft according to claim 20, wherein said mount body is connected to said platform at said rear end thereof by means of a wall of said platform connected to said mount body, one of said wall and said mount body having a plurality of selectable holes and a respective other of said wall and said mount body having at least one protrusion insertable into one of said selectable holes.

29. The watercraft according to claim 20, comprising a first rail extending between said rear end and said front end of said mount body, said first rail connected to said platform, said mount body pivotally connected to said first rail at said front end and selectively fastened at said rear end to adjust an elevation of said engine mount.

30. The watercraft according to claim 29, comprising a second rail extending between said rear end and said front end of said mount body, said second rail connected to said platform, said mount body pivotally connected to said second rail at said front end and selectively fastened at said rear end to adjust an elevation of said engine mounts, said first and second rails arranged on opposite sides of said mount body.

31. A watercraft, comprising:

a platform for carrying a payload;

a pair of side pontoons arranged beneath the platform for supporting the platform above a water line;

an engine mount assembly arranged between the pontoons, said engine mount assembly including an elongated mount body pivotally connected at a first end thereof to said platform and connected at a second, displaced end thereof at a selected position to said platform, and an engine-mounting wall connected to said mount body at said second end;

a center pontoon arranged beneath said platform between said side pontoon.

32. A watercraft according to claim 31, wherein said center pontoon comprises a substantially cylindrical body with a relieved top surface, said relieved top surface positioned in part beneath said elongated mount body to allow a range of position-adjusting movement of the second end of said mount body in a direction generally perpendicular to the platform.

33. A watercraft according to claim 31 wherein said center pontoon comprises a flat end wall at a rear end thereof.

34. A watercraft according to claim 31, wherein said relieved surface comprises a flat wall angled downwardly toward an end of said watercraft.

35. A watercraft according to claim 31, wherein said relieved surface comprises a concave wall.

36. A watercraft as in claim 31 which includes an outboard motor mounted to said engine-mounting wall.

* * * * *